US005826501A

United States Patent [19]

Gjervaldsäter

[11] Patent Number: 5,826,501

[45] Date of Patent: Oct. 27, 1998

[54] SYSTEM AT A MULTI-STAGE PRESS

[75] Inventor: Sixten Gjervaldsäter, Skärholmen, Sweden

[73] Assignee: Sunds Defibrator Industries AB, Sweden

[21] Appl. No.: 861,396

[22] Filed: May 21, 1997

[30] Foreign Application Priority Data

May 22, 1996 [SE] Sweden ..... 9601953

[51] Int. Cl.[6] ..... B30B 15/30

[52] U.S. Cl. ..... 100/196; 100/215; 100/218; 414/222; 414/277; 414/280; 425/338

[58] Field of Search ..... 100/113, 194, 100/196–198, 324, 215, 218; 414/222, 277, 280; 425/338, 339

[56] References Cited

U.S. PATENT DOCUMENTS 3,398,844 8/1968 Carlsson et al. .
3,664,524 5/1972 Yamauchi ..... 100/196
4,042,125 8/1977 Falkinger et al. ..... 100/196
4,348,144 9/1982 Nelson .
4,405,277 9/1983 Burkner et al. ..... 100/196
4,478,673 10/1984 Plocher ..... 100/196
4,527,938 7/1985 Leavitt, Jr. ..... 100/196
5,044,913 9/1991 Ostman ..... 100/194

*Primary Examiner*—Stephen F. Gerrity
*Attorney, Agent, or Firm*—Lerner, David, Littenberg, Krumholz & Mentlik

[57] ABSTRACT

Apparatus for pressing wet-formed fiber material boards in a multi-stage press is disclosed, including a vertically movable loading elevator with several stages for receiving transport plates for the boards, and a pusher for moving the transport plates from the loading elevator into the press. A hydraulic system is provided for driving both the loading elevator and the pusher.

9 Claims, 2 Drawing Sheets

SYSTEM AT A MULTI-STAGE PRESS

FIELD OF THE INVENTION

The present invention relates to a multi-stage press for pressing board from fiber material which has been manufactured by the so-called wet method. More particularly, the present invention relates to a system for feeding the board into the multi-stage press.

BACKGROUND OF THE INVENTION

A press of the type mentioned above is generally equipped with a plurality of transport plates, which are transferred from a multi-stage feeder to the press by means of a pusher. The boards are placed on the transport plates for pressing. The press is also equipped with a multi-stage outfeeder, to which the pressed boards are transferred by means of an extractor.

During the manufacture of fiberboard, particle board and the like, the fiber material is compressed in a press at high pressure and increased temperature, and a plurality of boards are pressed simultaneously in the press in several stages. The multi-stage press is charged from a loading elevator with transport plates in several stages. The entire package of transport plates can be moved into the press by means of a pusher. The multi-stage press consists of a plurality of press plates, which are vertically movable relative to each other, and which during the charging of the press are opened so that the transport plates with the fiber material can be inserted between the press plates. After the pressing, the press is again opened, and an extractor draws the transport plates with the finished board out of the press to an unloading elevator with a corresponding number of stages.

The transport plates with the fiber material are normally transported to the loading elevator by a belt conveyor or the like. The transport plates are transferred to the different stages of the loading elevator while the loading elevator is lifted in steps by means of a hydraulic lifting device. When the stages of the loading elevator are filled with transport plates, the plates are moved simultaneously into the press by means of the pusher, which is driven by an electric motor. After the pressing is completed, the transport plates with the ready-pressed board are drawn out of the press by the extractor, which like the pusher is driven by an electric motor, to the unloading elevator. The boards are transported from there by means of a belt conveyor or the like at the same time as the unloading elevator is lowered in steps by a hydraulic lifting device.

SUMMARY OF THE INVENTION

In accordance with the present invention, such apparatus has been improved by the invention of apparatus for pressing fibrous material board carried by a plurality of transport plates in a multi-stage press comprising a vertically movable loading elevator for receiving the plurality of transport plates carrying the fibrous material, the loading elevator including a plurality of stages for receiving the plurality of transport plates, a pusher for moving the plurality of transport plates from the loading elevator to the press, and a hydraulic drive system for vertically driving the loading elevator and for driving the pusher between the loading elevator and the press, whereby both the loading elevator and the pusher are hydraulically driven by the same hydraulic drive system.

In accordance with a preferred embodiment of the apparatus of the present invention, the apparatus includes a vertically movable unloading elevator for receiving a plurality of transport plates carrying the fibrous material, the unloading elevator including a plurality of stages for receiving the plurality of transport plates, an extractor for removing the plurality of transport plates from the press into the unloading elevator, and a secondary hydraulic drive system for vertically driving the unloading elevator and for driving the extractor between the press and the unloading elevator, whereby both the extractor and the unloading elevator are hydraulically driven by the same secondary hydraulic drive system.

In accordance with another embodiment of the apparatus of the present invention, the hydraulic drive system comprises a hydraulic cylinder for driving the pusher. In a preferred embodiment, the hydraulic cylinder comprises first and second concentric pistons whereby the stroke length of the hydraulic system may be extended.

In accordance with another embodiment of the apparatus of the present invention, the secondary hydraulic system comprises a secondary hydraulic cylinder for driving the extractor. Preferably, the secondary hydraulic cylinder comprises first and second secondary concentric pistons whereby the stroke length of the secondary hydraulic cylinder may be extended.

In accordance with another embodiment of the apparatus of the present invention, the first piston comprises a hollow and intermediate piston movable within the cylinder, and the second piston comprises an inner piston movable within the hollow intermediate piston. In a preferred embodiment, the hollow intermediate piston includes support means for supporting the first and second concentric pistons within the extended position. In another embodiment, the pusher is carried by a carriage, including tracks carried by the carriage, and wherein the support means comprises a plurality of support wheels capable of moving along the track means when the inner piston is moved with respect to the hollow intermediate piston.

According to the present invention, it is now possible to simplify the drive system in connection with such pressing, and at the same time to render the handling of the fiber material more efficient by means of a hydraulic drive system. At the same time, both reliability and safety are improved.

BRIEF DESCRIPTION OF THE DRAWINGS

The invention is described in greater detail in the following detailed description, which refers to the accompanying drawing illustrating an embodiment of the invention, in which.

DETAILED DESCRIPTION

Figure 1:
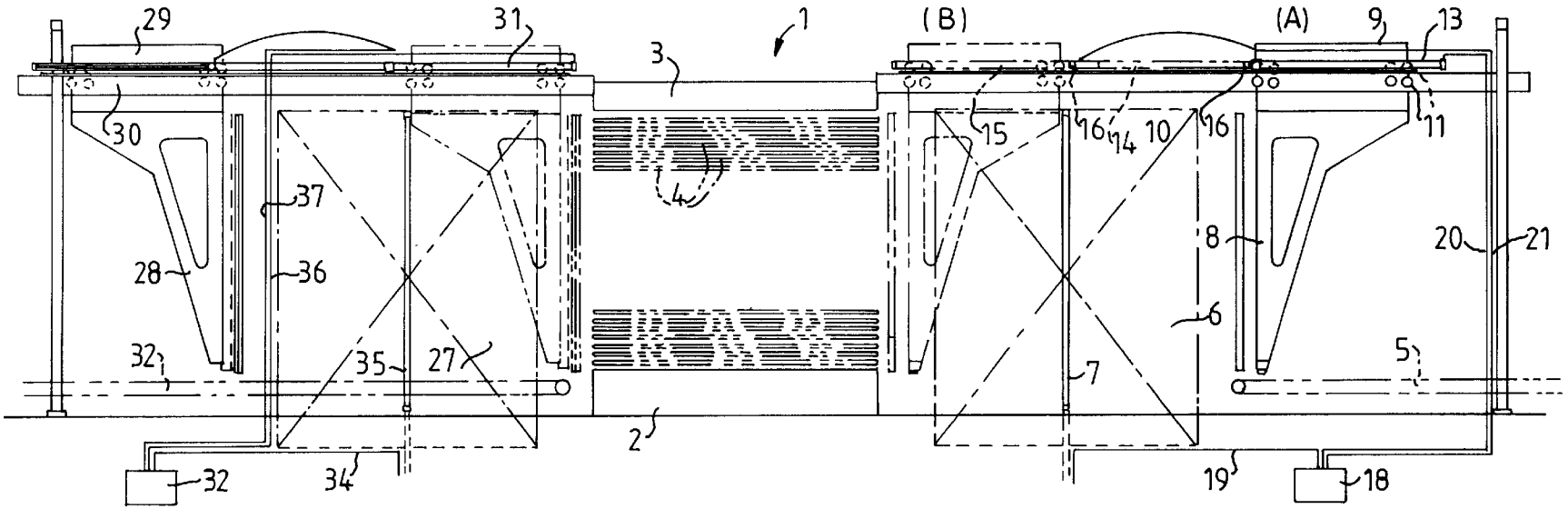
FIG. 1 is a side, elevational view of a multistage press with feeding and removal mechanisms according to the present invention.

Referring to the Figures, in which like reference numerals refer to corresponding elements thereof, FIG. 1 shows a multi-stage press 1 with a lower press plate 2, an upper press plate 3 and intermediate press plates 4. A belt conveyor 5 is provided for feeding transport plates with fiber material board to a loading elevator 6. The elevator comprises a number of stages which correspond to the press stages, and which can be lifted and lowered by a hydraulic cylinder 7. A pusher 8 is located on a carriage 9 which is movable along rails 10. The carriage 9 rolls on support wheels 11 and is laterally guided by guide wheels 12. The carriage of the pusher 9 is connected to a hydraulic cylinder 13, preferably with at least two concentric pistons for extended stroke length. In FIG. 1 the starting position (A) and pushed-in position (B) of the pusher are shown.

Figure 2:
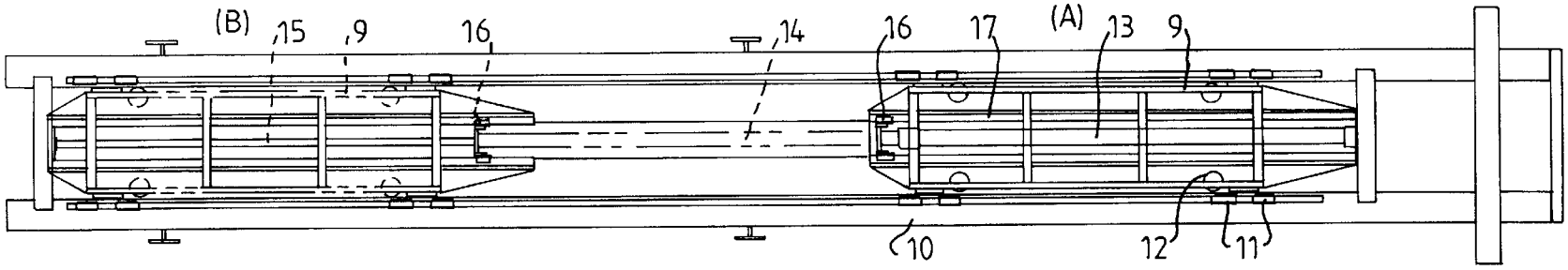
FIG. 2 is a top, elevational, elevational view of drive means for the feeding mechanism of the present invention.

In FIG. 2 the carriage 9 is shown from above, in its rear starting position (A) and in its advanced position (B). The hydraulic cylinder 13 comprises a movable concentric hollow intermediate piston 14 and an inner piston 15 movable within the intermediate piston. At the front end of the intermediate piston 14 supporting wheels 16 are provided, which roll along strips 17 on the carriage 9 when the inner piston is pushed out of the intermediate piston 14 and thereby providing support for the two pistons, 14 and 15, in their advanced position.

The hydraulic system comprises a control valve 18, from which a line 19 for hydraulic fluid extends to the hydraulic cylinder 7 of the loading elevator. Lines 20 and 21, respectively, for, hydraulic fluid extend to the hydraulic cylinder 13 of the pusher 8 for moving the pusher forward and rearward, respectively.

Figure 3:
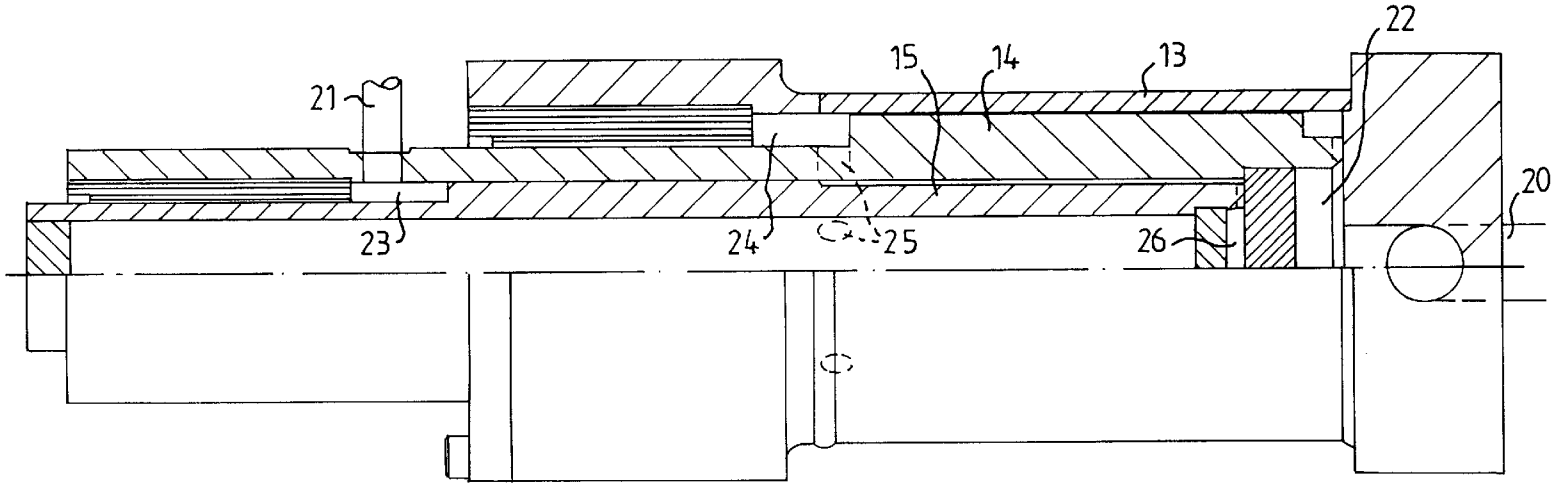
FIG. 3 is a side, elevational view of the drive means shown in FIG. 2.

FIG. 3 shows in principle the configuration of the hydraulic cylinder 13. The line 20 is connected to a rear chamber 22 in the cylinder 13 behind the pistons, 14 and 15. The line 21 is connected to a front chamber 23 between the inner piston 15 and the intermediate piston 14. A closed intermediate chamber 24 is located between the cylinder 13 and intermediate piston 14. The intermediate chamber 24 communicates through openings 25 in the intermediate piston with a space 26 behind the inner piston 15.

Upon pushing the transport plates into the press, the carriage 9, and thus the pusher 8, are driven forward to the press since hydraulic fluid is supplied through the line 20 through the control valve 18 to the chamber 22, so that the pistons, 14 and 15, are pressed forward. This implies that the fluid in the intermediate chamber 24 is pressed through the openings 25 into the space 26, so that the inner piston 15 is moved forward in the intermediate piston 14. The fluid is thereby pressed out from the chamber 23 and back through line 21 and control valve 18. In order to retract the pusher 8, the flow of the hydraulic fluid is reversed through the control valve 18 so that fluid is supplied through the line 21 and flows back through line 20.

The hydraulic system comprising both the loading elevator and the pusher permits the present system to be used efficiently. As the loading elevator 6 and the pusher 8 are not moved simultaneously, the same hydraulic system can be utilized for both operations, and the capacity of the system is used at its optimum. By driving the pusher hydraulically, the safety factor is increased as against unwanted transgressing of motion distances. The simplified design also implies substantially reduced costs compared with conventional systems.

Downstream of the press, a hydraulically driven unloading elevator 27 and a pusher 28 are located, which pusher 28, like the pusher 8, is located on a carriage 29 movable along rails 30. This carriage 29 also is connected to a hydraulic cylinder 31 having the same configuration as the hydraulic cylinder 13 of the pusher 8. Finally, a belt conveyor 32 is provided to move the transport plates with the ready-pressed board away from the unloading elevator 27.

On the unloading side of the press corresponding hydraulic systems are also provided; i.e., a control valve 33 with a line 32 to the hydraulic cylinder 35 of the unloading elevator 27 and lines, 36 and 37, to the hydraulic cylinder 31 of the pusher 28.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. Apparatus for pressing fibrous material board carried by a plurality of transport plates in a multi-stage press comprising a vertically movable loading elevator for receiving said plurality of transport plates carrying said fibrous material, said loading elevator including a plurality of stages for receiving said plurality of transport plates, a pusher for moving said plurality of transport plates from said loading elevator to said press, and a hydraulic drive system for vertically driving said loading elevator and for driving said pusher between said loading elevator and said press, whereby both said loading elevator and said pusher are hydraulically driven by the same hydraulic drive system.

2. The apparatus of claim 1 including a vertically movable unloading elevator for receiving said plurality of transport plates carrying said fibrous material, said unloading elevator including a plurality of stages for receiving said plurality of transport plates, an extractor for moving said plurality of transport plates from said press into said unloading elevator, and a secondary hydraulic drive system for vertically driving said unloading elevator and for driving said extractor between said press and said unloading elevator, whereby both said extractor and said unloading elevator are hydraulically driven by the same secondary hydraulic drive system.

3. The apparatus of claim 2 wherein said secondary hydraulic drive system comprises a secondary hydraulic cylinder for driving said extractor.

4. The apparatus of claim 3 wherein said secondary hydraulic cylinder comprises first and second secondary concentric pistons whereby the stroke length of said secondary hydraulic cylinder may be extended.

5. The apparatus of claim 1 wherein said hydraulic drive system comprises a hydraulic cylinder for driving said pusher.

6.The apparatus of claim 5 wherein said hydraulic cylinder comprises first and second concentric pistons whereby the stroke length of said hydraulic cylinder may be extended.

7. The apparatus of claim 6 wherein said first piston comprises a hollow intermediate piston movable within said cylinder and said second piston comprises an inner piston movable within said hollow intermediate piston.

8. The apparatus of claim 7 wherein said hollow intermediate piston includes support means for supporting said first and second concentric pistons when in said extended position.

9. The apparatus of claim 8 wherein said pusher is carried by a carriage, including tracks carried by said carriage, and wherein said support means comprises a plurality of support wheels capable of moving along said track means when said inner piston is moved with respect to said hollow intermediate piston.

* * * * *